US011497672B2

(12) United States Patent
Zhang et al.

(10) Patent No.: US 11,497,672 B2
(45) Date of Patent: Nov. 15, 2022

(54) SOFT KNEE EXOSKELETON DRIVEN BY NEGATIVE-PRESSURE LINEAR ACTUATOR

(71) Applicant: Beijing Institute of Technology, Beijing (CN)

(72) Inventors: Liancun Zhang, Beijing (CN); Qiang Huang, Beijing (CN); Wenkang Wang, Beijing (CN)

(73) Assignee: Beijing Institute of Technology, Beijing (CN)

( * ) Notice: Subject to any disclaimer, the term of this patent is extended or adjusted under 35 U.S.C. 154(b) by 339 days.

(21) Appl. No.: 16/812,278

(22) Filed: Mar. 7, 2020

(65) Prior Publication Data

US 2020/0206064 A1 Jul. 2, 2020

Related U.S. Application Data

(63) Continuation of application No. PCT/CN2018/074330, filed on Jan. 26, 2018.

(30) Foreign Application Priority Data

Jan. 2, 2018 (CN) ..... 201810000925.4

(51) Int. Cl.
*A61H 3/00* (2006.01)

(52) U.S. Cl.
CPC ..... *A61H 3/00* (2013.01); *A61H 2201/0214* (2013.01); *A61H 2201/1238* (2013.01);
(Continued)

(58) Field of Classification Search
CPC ..... A61H 3/00; A61H 2201/0214; A61H 2201/1238; A61H 2201/1642;
(Continued)

(56) References Cited

U.S. PATENT DOCUMENTS 10,377,036 B2 8/2019 Namoun et al.
10,576,620 B1 * 3/2020 Chou ..... A61F 2/72
(Continued)

FOREIGN PATENT DOCUMENTS

CN 104401419 A 3/2015
CN 205391322 U 7/2016
(Continued)

OTHER PUBLICATIONS

Attachment of English translation for CN106420279A description and claims; 2016.*
(Continued)

*Primary Examiner* — Samchuan C Yao
*Assistant Examiner* — Tyler A Raubenstraw

(57) ABSTRACT

The present invention discloses a soft knee exoskeleton driven by a negative-pressure linear actuator, including: an exoskeleton controller, a left leg knee joint soft actuator, a right leg knee joint soft actuator and the like. The soft knee exoskeleton mainly uses a miniature vacuum negative pressure pump as an air pressure power source. A DSP embedded control system performs real-time processing on the data, such as a muscle force, a knee joint angle and a human-machine interaction force, detected by a sensing system, estimates a human-machine cooperation state, and performs real-time control on the switching of the negative pressure flow and an air channel of the miniature vacuum negative pressure pump.

8 Claims, 8 Drawing Sheets

(52) U.S. Cl.
CPC ..... *A61H 2201/165* (2013.01); *A61H 2201/1642* (2013.01); *A61H 2201/1671* (2013.01); *A61H 2201/5061* (2013.01); *A61H 2201/5069* (2013.01); *A61H 2201/5079* (2013.01); *A61H 2201/5097* (2013.01); *A61H 2205/102* (2013.01); *A61H 2230/085* (2013.01)

(58) Field of Classification Search
CPC .... A61H 2201/1671; A61H 2201/5061; A61H 2201/5069; A61H 2201/5097; A61H 2205/102; A61H 1/0237; A61H 1/024; A61H 1/0244; A61H 1/0255; A61H 1/0259; A61H 1/0262; A61H 2201/165; A61H 2201/102; B25J 9/0006
See application file for complete search history.

(56) References Cited

U.S. PATENT DOCUMENTS

2004/0158175 A1* 8/2004 Ikeuchi ..... A61H 3/00 601/5
2007/0179416 A1* 8/2007 Obrien ..... A61H 9/00 601/149
2011/0166489 A1* 7/2011 Angold ..... A61H 3/008 601/34
2014/0100493 A1 4/2014 Craig et al.
2014/0358053 A1* 12/2014 Triolo ..... B25J 9/0006 602/19
2015/0158175 A1* 6/2015 Kim ..... B25J 9/0006 700/261
2015/0359698 A1* 12/2015 Popovic ..... A61H 1/0281 60/530
2016/0215864 A1* 7/2016 Kim ..... A61F 2/60
2016/0339506 A1 11/2016 Blacket et al.
2017/0143517 A1* 5/2017 Sankai ..... A61B 5/11
2017/0202724 A1* 7/2017 De Rossi ..... A61H 3/00

FOREIGN PATENT DOCUMENTS

CN 106420279 A * 12/2016 ..... A61B 5/112
CN 106420279 A 2/2017
CN 106491319 A 3/2017
EP 0254522 A2 1/1998

OTHER PUBLICATIONS

Internation Search Report of PCT/CN2018/074330, dated Sep. 26, 2018.

* cited by examiner

SOFT KNEE EXOSKELETON DRIVEN BY NEGATIVE-PRESSURE LINEAR ACTUATOR

CROSS-REFERENCE TO RELATED APPLICATIONS

This application is a continuation of International Patent Application No. PCT/CN2018/074330 with a filing date of Jan. 26, 2018, designating the United States, and further claims priority to Chinese Patent Application No. 201810000925.4 with a filing date of Jan. 2, 2018. The content of the aforementioned applications, including any intervening amendments thereto, are incorporated herein by reference.

TECHNICAL FIELD

The present invention belongs to the technical field of soft exoskeleton robots, lower limb exoskeletons and soft actuators, and particularly relates to a soft knee exoskeleton driven by a negative-pressure linear actuator.

BACKGROUND OF THE PRESENT INVENTION

In 1992, the World Health Organization stated that walking is the best exercise in the world and has special benefits for health. Since people spent 6 million years to evolve from apes to men, and the entire human body structure is the result of walking evolution, the human body structure is most suitable for walking from the perspective of human anatomy and physiological structure. When people walk, the weight born by the hip joint, the knee joint and the ankle joint is 3 to 5 times the total weight of the body; and the hip joint and the knee joint are two joints that are easily injured. According to a survey of 2500 persons by the Peking University Health Science Center, the prevalence of knee arthritis in the elderly over the age of 60 is 27.6%, while the prevalence of hip arthritis in the elderly is 0.8%. Obviously, the knee arthritis and injury rates are higher. According to incomplete statistics, there are more than 500 million people with knee joint injuries in the world. Daily walking will increase the stress on the knee joint of people with knee joint injuries and accelerate knee joint injuries. Without daily walking exercises, muscles will atrophy due to disuse. People with knee joint injuries have certain walking ability. Appropriate walking assistance can reduce the stress on the knee joint, strengthen leg muscle strength, maintain mobility of the knee joint, protect the knee joint, and help to improve the living quality of the people.

SUMMARY OF PRESENT INVENTION

Technical Problem

At present, the traditional lower limb exoskeleton mainly adopts a rigid exoskeleton for enhancing the weight-bearing capacity of soldiers, and to provide support for paralyzed patients, a rigid mechanism is used to drive the patients to walk. The traditional lower limb exoskeleton equipment has the disadvantages of inconvenient wearing, bulkiness, short working time, high selling price, danger of mechanical inertia, and lack of psychological recognition. In conclusion, the traditional lower limb walking-assisting exoskeleton is not suitable for people with knee joint injuries that require only partial walking assistance and have poor walking ability.

Technical Solution

The purpose of the present invention is to provide a soft knee exoskeleton driven by a negative-pressure linear actuator with respect to the defects of the prior art. The soft knee exoskeleton mainly uses a miniature vacuum negative pressure pump as an air pressure power source. The soft knee exoskeleton acquires parameters such as muscle force, a knee joint angle and human-machine interaction force by a sensing system of a soft knee exoskeleton formed by an inertial measurement unit (IMU) component, a force sensor and a surface myoelectric sensor (sEMG). A DSP embedded control system performs real-time processing on the data detected by the sensing system, estimates a human-machine cooperation state, and performs real-time control on the switching of the negative pressure flow and an air channel of the miniature vacuum negative pressure pump. The pressure control is performed on the corresponding negative-pressure linear actuator drivers on a left leg knee joint soft actuator and a right leg knee joint soft actuator based on a human-machine cooperation state. In the walking process, the torque which assists the knee joint in bending and extending is provided for the left and right legs, thereby achieving the purpose of providing soft walking assistance for the elderly people with knee joint motion injuries and weak walking ability.

In order to achieve the above purpose, the technical solution adopted by the present invention is as follows:

A soft knee exoskeleton driven by a negative-pressure linear actuator includes:

an exoskeleton controller including a control part and a pneumatic power output part;

a left leg knee joint soft actuator worn on a left leg knee joint and capable of assisting knee joint motion of a left leg;

a right leg knee joint soft actuator worn on a right leg knee joint and capable of assisting knee joint motion of a right leg, wherein the left leg knee joint soft actuator and the right leg knee joint soft actuator include a pneumatic driving mechanism and a sensing system;

the pneumatic driving mechanism can accept the power outputted by the exoskeleton controller to provide a torque for the knee joints;

the sensing system can detect human-machine interaction state data; and the control part can process the data detected by the sensing system and control the power output of the left leg knee joint soft actuator and the right leg knee joint soft actuator.

Preferably, the exoskeleton controller includes: a controller body, an end cover, a miniature vacuum negative pressure pump, a mounting plate, a T-type three-way adapter, a vacuum solenoid valve A, a vacuum solenoid valve B, a driver, a DSP embedded control system, a lithium battery pack, a wireless receiving and transmitting module, a switch, a right air tube R, a left air tube L, a heat sink block A, a heat sink block B and a soft belt.

Preferably, each of the left leg knee joint soft actuator and the right leg knee joint soft actuator includes a knee joint elastic sheath, a soft torque execution component A, a soft torque execution component B, a Y-type three-way adapter, an air tube component, an inertial measurement unit (IMU) component, a force sensor, a surface myoelectric sensor (sEMG) and elastic cloth.

Preferably, the soft torque execution component A includes a left thigh brace, a left calf brace, a negative-pressure linear actuator driver, a rotating shaft, a connector, a screw, a fastener, a pressing piece component, a latex rubber band and an air tube connecting end.

A triangular structural form with fixed lengths on both sides and a variable length on the third side is formed by the left thigh brace, the left calf brace and the negative-pressure linear actuator driver. The relative rotation of the other two fixed sides is achieved by the change in the length of the third side.

The soft torque execution component A is stitched to a position corresponding to a left knee joint of a knee joint elastic sheath by the elastic cloth.

Preferably, the soft torque execution component B includes a right thigh brace, a right calf brace, a negative-pressure linear actuator driver, a rotating shaft, a connector, a screw, a fastener, a pressing piece component, a latex rubber band and an air tube connecting end.

A triangular structural form with fixed lengths on both sides and a variable length on the third side is formed by the right thigh brace, the right calf brace and the negative-pressure linear actuator driver. The relative rotation of the other two fixed sides is achieved by the change in the length of the third side.

The soft torque execution component B is stitched to a position corresponding to a right knee joint of a knee joint elastic sheath by the elastic cloth.

Preferably, the left leg knee joint soft actuator and the right leg knee joint soft actuator provide the auxiliary torque for the knee joints through the simultaneous action of the soft torque execution component A and the soft torque execution component B.

Preferably, when the negative-pressure linear actuator driver has a negative-pressure input, the driver has shorter linear displacement, a tensile force, and basically unchanged size in the direction perpendicular to the linear displacement. On the contrary, when the negative pressure of the negative-pressure linear actuator driver gradually disappears, the driver has an elastic acting force in a process of restoring from a contraction state to a natural state.

Preferably, during the process that the negative pressure action of the negative-pressure linear actuator driver gradually disappears, the latex rubber band on the end faces of the braces on both sides of the thigh and the braces on both sides of the calf is no longer subjected to an external force, and thus, jointly acts with the negative-pressure elastomer to drive the relative rotation of the braces on both sides of the thigh and the braces on both sides of the calf, and an extended torque is generated, thereby realizing the function of the soft torque execution component A and the soft torque execution component B to provide an auxiliary extension torque for the knee joints.

Preferably, the negative-pressure linear actuator driver includes an upper half part and a lower half part which are basically symmetrical, wherein the upper half part has a vent hole with the outside used to connect the air tubes to realize the negative pressure input or positive pressure input to the entire negative-pressure linear actuator driver.

The upper half part and the lower half part of the negative-pressure linear actuator driver respectively include an air chamber of a hexagonal prism structure. Grooves are formed on each air chamber to form an airflow channel of the negative-pressure linear actuator driver. Six air chamber beams of the side surface of a single air chamber are different in thickness, wherein the thickness of the second air chamber beam is three times the first air chamber beam. Grooves are formed on four adjacent first air chamber beams of the upper and lower adjacent air chambers to form the airflow channel of the negative-pressure linear actuator driver, and no groove is formed on the other four nonadjacent first air chamber beams; and no groove is formed on the second air chamber beam to ensure airtightness. When the air chamber is under negative pressure, the first air chamber beam is deformed by the negative pressure force and contracts in an X axis direction to form a linear displacement; the second air chamber beam is not deformed and has no contraction displacement in a Y axis direction. Therefore, when the negative pressure acts, the negative-pressure linear actuator driver can form a horizontal linear displacement. When the external negative pressure action disappears, the first air chamber beam disappears due to the negative pressure force and extends in the opposite direction of the X axis, and gradually restores to the initial state of being not subjected to stress, and a horizontal displacement is formed in the process which is controllable; and the second air chamber beam is not deformed and has no contraction or extension displacement in a Y direction.

Preferably, the inertial measurement unit (IMU) component is a sensor that detects the change of a knee joint angle and/or angular velocity; the surface myoelectric sensor (sEMG) is a sensor that detects a muscle force and a joint torque; the force sensor is a sensor that acquires a human-machine interaction force between the soft knee exoskeleton and a human leg; the sensing system of the soft knee exoskeleton is formed by the inertial measurement unit (IMU) component, the surface myoelectric sensor (sEMG) and the force sensor; and the wireless receiving and transmitting module is a communication module between the DSP embedded control system and the sensing system.

The DSP embedded control system performs real-time processing on the parameters of the knee joint angle and/or angular velocity of the left and right legs acquired by the inertial measurement unit module, estimates and predicts a muscle force, a joint torque and a human-machine interaction force detected by the force sensor and the surface myoelectric sensor (sEMG performs real-time control on the output flow of the miniature vacuum negative pressure pump and switches an air channel of a vacuum solenoid valve A and a vacuum solenoid valve B. The real-time negative pressure input and positive pressure input control is performed on the negative-pressure linear actuator drivers in a soft torque execution component A and a soft torque execution component B on the left leg knee joint soft actuator and the right leg knee joint soft actuator based on a human-machine cooperation state, thereby controlling the torque output of the left leg knee joint soft actuator and the right leg knee joint soft actuator in real time.

Preferably, the left thigh brace, the right thigh brace, the left calf brace and the right calf brace are made of high-strength synthetic resin materials or carbon fibers and other non-metal materials, or light-weight alloy materials such as aluminum-magnesium alloy and hard aluminum alloy.

Beneficial Effects

Traditional hydraulic drive and motor drive have the disadvantages of noise and low power density. The current exoskeleton system is generally based on DC servo motor drive and harmonic reducer drive. However, since the power density of the traditional motor decreases rapidly with the decrease of the volume, and transmission errors and friction forces exist, the improvement of the power density and the overall response performance of a drive system is limited; the power density is relatively low; the structure is complex; compliance control is difficult to achieve; and essential compliance is lacked. In addition, soft drivers such as pneumatic artificial muscles have higher power density ratio and power volume ratio, but have the disadvantages of friction, nonlinear deformation, difficulty in precise modeling, and difficulty in motion control. The present invention adopts the negative-pressure linear actuator as the soft driving element, has higher power density ratio and power volume ratio, has the characteristic of linear deformation, and is easy to realize human-machine coordinated control of the soft knee exoskeleton.

Since the soft knee exoskeleton driven by the negative-pressure linear actuator adopts the sensing system of the soft knee exoskeleton formed by the inertial measurement unit component, the force sensor and the surface myoelectric sensor (sEMG), the sEMG contains a variety of muscular activity information, which can directly reflect the functional state and motion information of the muscle. By establishing a muscle-skeletal model driven by the surface myoelectric sensor (forward dynamics) and combining the inertial information of the inertial measurement unit module, the parameter identification is performed; the muscle force, the knee joint angle, the knee joint angular velocity and the human-machine interaction force are estimated and predicted; and the human-machine cooperation state is estimated to improve the coordination and safety of the soft exoskeleton.

Compared with the prior art, a pneumatic driving mode is adopted for the left leg knee joint soft actuator and the right leg knee joint soft actuator in the soft knee exoskeleton driven by the negative-pressure linear actuator in the present invention, which overcomes the disadvantages of large inertia, easy mechanical inertia damage of the knee joint, poor safety and poor comfort of general leg power assisting equipment or an exoskeleton robot and other rigid mechanisms, thereby significantly improving the safety and comfort of the equipment.

Therefore, the present invention uses a miniature vacuum negative pressure pump as an air pressure power source. The sensing system of the soft knee exoskeleton is formed by the inertial measurement unit component, the force sensor and the surface myoelectric sensor (sEMG) to detect the muscle force, the knee joint angle, the knee joint angular velocity and the human-machine interaction force. The DSP embedded control system performs real-time processing on the data detected by the sensing system, estimates the human-machine cooperation state, and performs real-time control on the switching of the negative pressure flow and the air channel of the miniature vacuum negative pressure pump. The pressure control is performed on the corresponding negative-pressure linear actuator drivers on the left leg knee joint soft actuator and the right leg knee joint soft actuator based on the human-machine cooperation state. In the walking process, the torque which assists the knee joint in bending and extending is provided for the left and right legs, thereby achieving the purpose of providing soft walking assistance for the elderly people with knee joint motion injuries and weak walking ability.

LIST OF REFERENCE NUMERALS IN THE DRAWINGS

1. exoskeleton controller; 2. left leg knee joint soft actuator; 3. right leg knee joint soft actuator;

101. controller body; 102. end cover; 103. miniature vacuum negative pressure pump; 104. mounting plate; 105. T-type three-way adapter; 106. vacuum solenoid valve A; 107. vacuum solenoid valve B; 108. DSP embedded control system; 109. driver; 110. right air tube R; 111. left air tube L; 112. lithium battery pack; 113. wireless receiving and transmitting module; 114. switch; 115. heat sink block A; 116. heat sink block B; 117. soft belt;

201. knee joint elastic sheath; 202. soft torque execution component A; 203. soft torque execution component B; 204. inertial measurement unit (IMU) component; 205. surface myoelectric sensor (sEMG); 206. force sensor; 207. Y-type three-way adapter A; 208. Y-type three-way adapter B; 209. air tube A; 210. air tube B; 211. air tube C; 212. air tube D;

301. left thigh brace; 302. left calf brace; 303. negative-pressure linear actuator driver; 304. rotating shaft; 305. connector; 306. screw; 307. fastener; 308. pressing piece A; 309. pressing piece B; 310. latex rubber band; 311. first air tube connecting end (connecting the air tube B or air tube D);

401. right thigh brace; 402. right calf brace; 403. second air tube connecting end (connecting the air tube A or air tube C);

501. upper half negative-pressure linear actuator; 502. lower half negative-pressure linear actuator.

DETAILED DESCRIPTION OF PREFERRED EMBODIMENTS

The present invention is further described below in combination with the drawings and specific embodiments, but is not limited.

Figure 1:
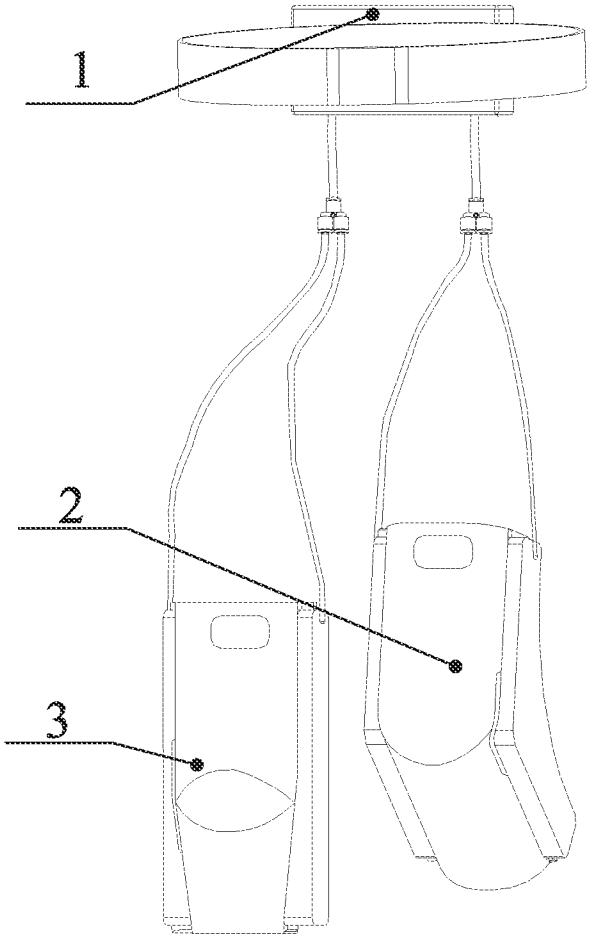
FIG. 1 is an outline drawing of a soft knee exoskeleton of the present invention.

As shown in FIG. 1, a soft knee exoskeleton driven by a negative-pressure linear actuator is mainly composed of an exoskeleton controller 1, a left leg knee joint soft actuator 2 and a right leg knee joint soft actuator 3. The exoskeleton controller 1 is a control and power output component of the soft knee exoskeleton; and the left leg knee joint soft actuator 2 and the right leg knee joint soft actuator are respectively worn on soft assisted execution components of the left and right leg knee joints of a user.

Figure 2:
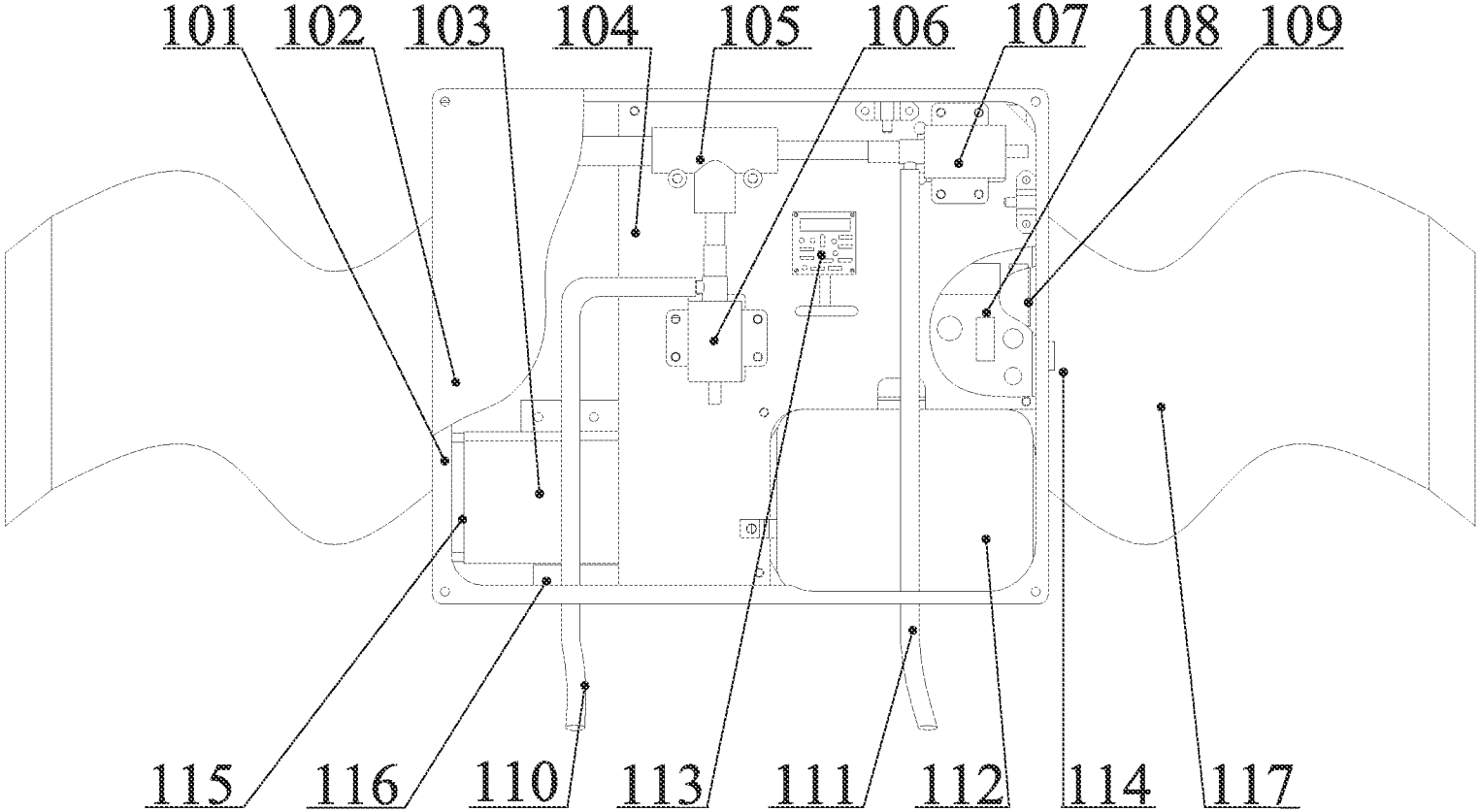
FIG. 2 is a composition diagram of an exoskeleton controller in FIG. 1.

As shown in FIG. 2, the exoskeleton controller 1 mainly includes a controller body 101, an end cover 102, a miniature vacuum negative pressure pump 103, a mounting plate 104, a T-type three-way adapter 105, a vacuum solenoid valve A 106, a vacuum solenoid valve B 107, a DSP embedded control system 108, a driver 109, a right air tube R 110, left air tube L 111, a lithium battery pack 112, a wireless receiving and transmitting module 113, a switch 114, a heat sink block A 115, a heat sink block B 116, and a soft belt 117.

Figure 3:
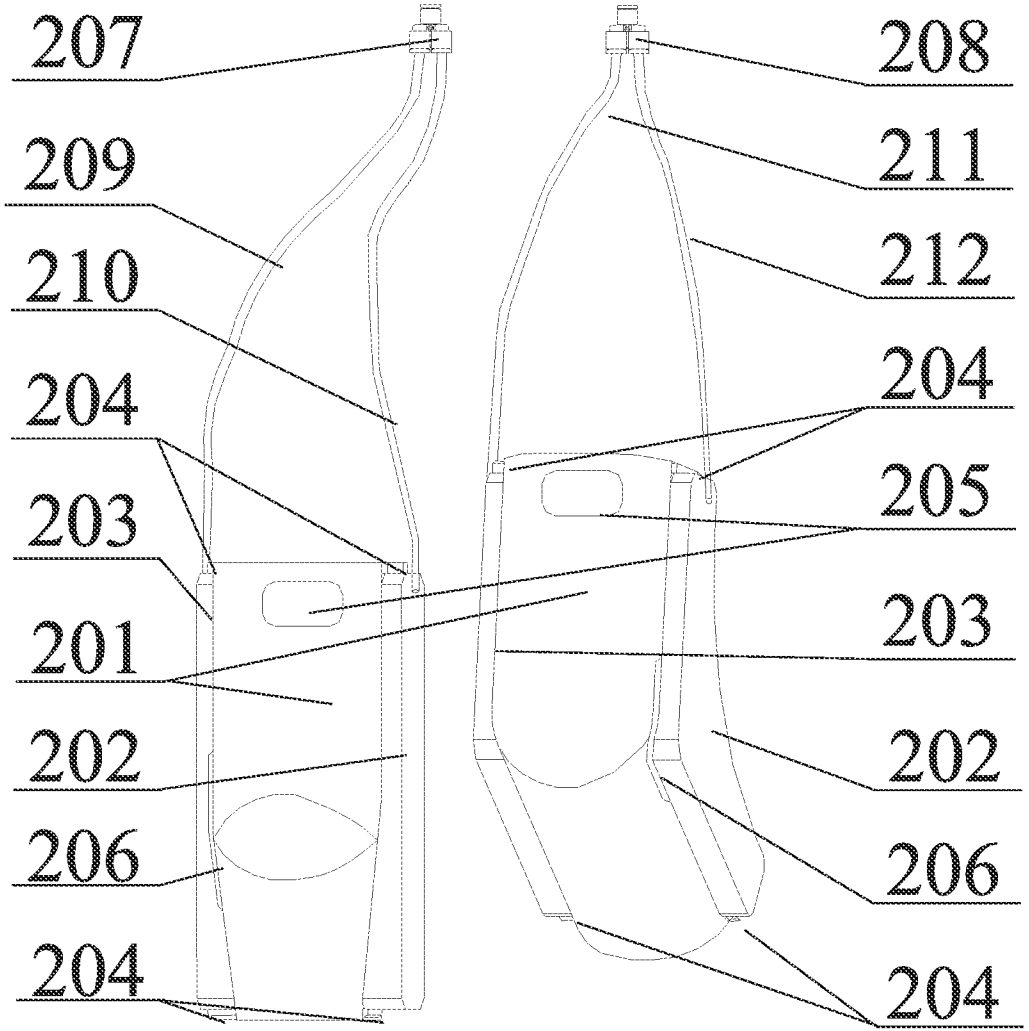
FIG. 3 is a composition diagram of a left leg knee joint soft actuator and a right leg knee joint soft actuator in FIG. 1.

As shown in FIG. 3, the left leg knee joint soft actuator 2 and the right leg knee joint soft actuator 3 include a knee joint elastic sheath 201, a soft torque execution component A 202, a soft torque execution component B 203, an inertial measurement unit (IMU) component 204, a surface myoelectric sensor (sEMG) 205, a force sensor 206, a Y-type three-way adapter A 207, a Y-type three-way adapter B 208, an air tube A 209, an air tube B 210, an air tube C 211, and an air tube D 212.

Figure 4:
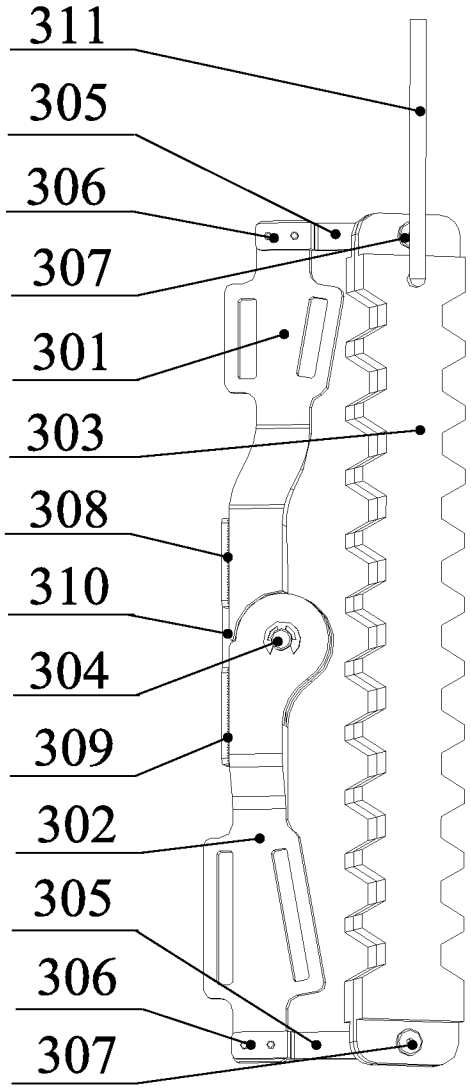
FIG. 4 is a composition diagram of a soft torque execution component A in FIG. 3.

As shown in FIG. 4, the soft torque execution component A 202 includes a left thigh brace 301, a left calf brace 302, a negative-pressure linear actuator driver 303, a rotating shaft 304, a connector 305, a screw 306, a fastener 307, a pressing piece A 308, a pressing piece B 309, a latex rubber band 310, and a first air tube connecting end 311 (representing the air tube B or the air tube D).

Figure 5:
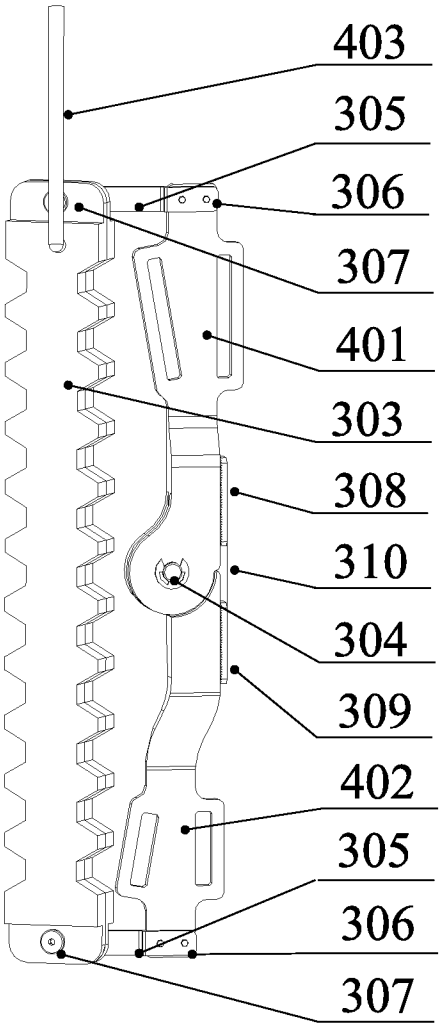
FIG. 5 is a composition diagram of a soft torque execution component B in FIG. 3.

As shown in FIG. 5, the soft torque execution component B 203 includes a right thigh brace 401, a right calf brace 402, a negative-pressure linear actuator driver 303, a rotating shaft 304, a connector 305, a screw 306, a fastener 307, a pressing piece A 308, a pressing piece B 309, a latex rubber band 310, and a second air tube connecting end 403 (connecting the air tube A or the air tube C).

As shown in FIGS. 1-5, the miniature vacuum negative pressure pump 103 is a power source of the soft knee exoskeleton, and provides a negative pressure force for the left leg knee joint soft actuator 2 and the right leg knee joint soft actuator 3. The driver 109 controls a speed and an acceleration of a motor in the miniature vacuum negative pressure pump 103 by controlling a pulse frequency, thereby achieving flow control of the miniature vacuum negative pressure pump. The vacuum solenoid valve A106 and the vacuum solenoid valve B107 are three-way solenoid valves, which can realize air channel switching. The inertial measurement unit (IMU) component 204 is a sensor that detects change in parameters such as a knee joint angle and an angular velocity. The surface myoelectric sensor (sEMG) 205 is a sensor that detects a muscle force and a joint torque. The force sensor 206 is a sensor that acquires a human-machine interaction force between the soft knee exoskeleton and a leg. The inertial measurement unit (IMU) component 204, the surface myoelectric sensor (sEMG) 205, and the force sensor 206 constitute a sensing system for the soft knee exoskeleton. The wireless receiving and transmitting module 113 is a communication module between the DSP embedded control system and the soft exoskeleton sensing system. Motion state data of the user is transmitted to the DSP embedded control system 108 via the wireless receiving and transmitting module 113 by wireless transmission. The DSP embedded control system 108 is a control center of the soft knee exoskeleton, performs real-time processing to parameters detected by the sensing system of the soft knee exoskeleton, such as a change in the knee joint angle and the angular velocity, the human-machine interaction force, the muscle force and the joint torque, and estimates and predicts a human-machine cooperation state. The estimation of the human-machine cooperation state is the key to the human-machine coordinated control of a human and the knee joint exoskeleton. The actions performed by the exoskeleton must conform to a behavioral mode and a behavior intention of an operator, which is related to the coordination and safety of the execution of the exoskeleton actions. The estimation of the human-machine cooperation state of the soft exoskeleton is mainly implemented by information based on IMU inertia information, force feedback information and the sEMG. The muscle force generated when a person wears a soft exoskeleton for motion can visually reflect the motion state and the behavior intention of a human body. The fast and accurate detection of the muscle force is the key to achieving harmonious natural human-machine interaction. The sEMG contains a variety of muscle activity information, which can directly reflect the functional state and motion information of the muscle. The sEMG-driven forward musculoskeletal model is a main control source. In accordance with the motion recognition and modeling of various joint-related muscles of the human body and in combination with the inertia information and the force feedback information, parameter identification is conducted; the muscle force and joint torque are estimated and predicted; the fine motion is estimated; and the estimation of the human-machine cooperation state is realized, thereby providing a core driving signal source for the soft knee exoskeleton. Under the excitation of the signal source, the DSP embedded control system 108 controls an output flow of the miniature vacuum negative pressure pump 103 in real time and controls the vacuum solenoid valve A 106 and the vacuum solenoid valve B 107 to perform the air channel switching. Negative pressure input and positive pressure input control is performed on the negative-pressure linear actuator driver 303 on the soft torque execution component A 202 and the soft torque execution component B 203 based on the human-machine cooperation state, to control torque output of the soft torque execution component A 202 and the soft torque execution component B 203 and to achieve that the left leg knee joint soft actuator 2 and the right leg knee joint soft actuator 3 provide real-time control for the knee joint of the user in a torque extending and bending process, thereby providing guarantee for the human-machine coordinated control.

The control box mounting housing is a main mounting carrier of components, such as the miniature vacuum negative pressure pump 103, the mounting plate 104, the T-type three-way adapter 105, the vacuum solenoid valve A 106, the vacuum solenoid valve B 107, the DSP embedded control system 108, the driver 109, the right air tube R 110, the left air tube L 111, the lithium battery pack 112, the wireless receiving and transmitting module 113, the switch 114, the heat sink block A 115, the heat sink block B 116, and the soft belt 117.

As shown in FIG. 4, the soft torque execution component A 202 is of a triangular structure which is mainly formed by the left thigh brace 301, the left calf brace 302 and the negative-pressure linear actuator driver 303 and has fixed lengths on both sides and a variable length on the third side. The relative rotation of the other two fixed sides is achieved by the change in the length of the third side. Specifically, the left thigh brace 301 and the left calf brace 302 are connected by the rotating shaft 304 and can rotate around the rotating shaft 304, and the left thigh brace 301 has a limiting stand to ensure that the maximum angle between the left calf brace 302 and the left thigh brace 301 is 180 degrees when the left calf brace 302 rotates clockwise around the rotating shaft, which is also the maximum extension angle of the knee joint of an ordinary person. The latex rubber band 310 is respectively pressed on end faces of the left thigh brace 301 and the left calf brace 302 by a pressing piece A 308 and a pressing piece B 309, and the left calf brace 302 can play a tensioning role when rotating counterclockwise about the rotating shaft 304 with respect to the left thigh brace 301. The negative-pressure linear actuator driver 303 is respectively fixed to both ends of the left calf brace 302 by the connector 305, the screw 306, the fastener 307 and the left thigh brace 301. The left thigh brace 301, the left calf brace 302 and the negative-pressure linear actuator driver 303 form a triangular structure form, which becomes shorter when the negative-pressure linear actuator driver 303 has a negative pressure input, and can drive the left calf brace 302 to rotate around the rotating shaft 304 with respect to the left thigh brace 301 (the angle between the two becomes smaller), and a bending torque is generated, thereby realizing the function of the soft torque execution component A 202 to provide an auxiliary bending torque for the knee joint. In the above process, the latex rubber band 310 on the end faces of the left thigh brace 301 and the left calf brace 302 is stressed and tensioned by the relative rotation of the left thigh brace 301 and the left calf brace 302. On the contrary, when the negative pressure of the negative-pressure linear actuator driver 303 gradually disappears, the driver has an elastic acting force in a process of restoring from a contraction state to a natural state. During the process that the negative pressure of the negative-pressure linear actuator driver 303 gradually disappears, the latex rubber band 310 on the end faces of the left thigh brace 301 and the left calf brace 302 is no longer subjected to an external force, and thus, jointly acts with the negative-pressure elastomer to drive the relative rotation (the angle becomes larger) of the left thigh brace 301 and the left calf brace 302, and an extended torque is generated, thereby realizing the function of the soft torque execution component A 202 to provide an auxiliary extension torque for the knee joint.

FIG. 5 is the soft torque performance component B 203, which has the same installation mode and structure mechanism as the soft torque execution component A 202, except for different structural sizes and forms between the right thigh brace 401 and the left thigh brace 301 and between the right calf brace 402 and the left calf brace 302. So no more description is made here.

The soft torque execution component A 202 is stitched to a position corresponding to a left knee joint of the knee joint elastic sheath 201 by an elastic cloth; and the soft torque execution component B 203 is stitched to a position corresponding to a right knee joint of the knee joint elastic sheath 201 by the elastic cloth. The left leg knee joint soft actuator 2 and the right leg knee joint soft actuator 3 provide the auxiliary torque for the knee joint through the simultaneous action of the soft torque execution component A 202 and the soft torque execution component B 203.

Figure 6:
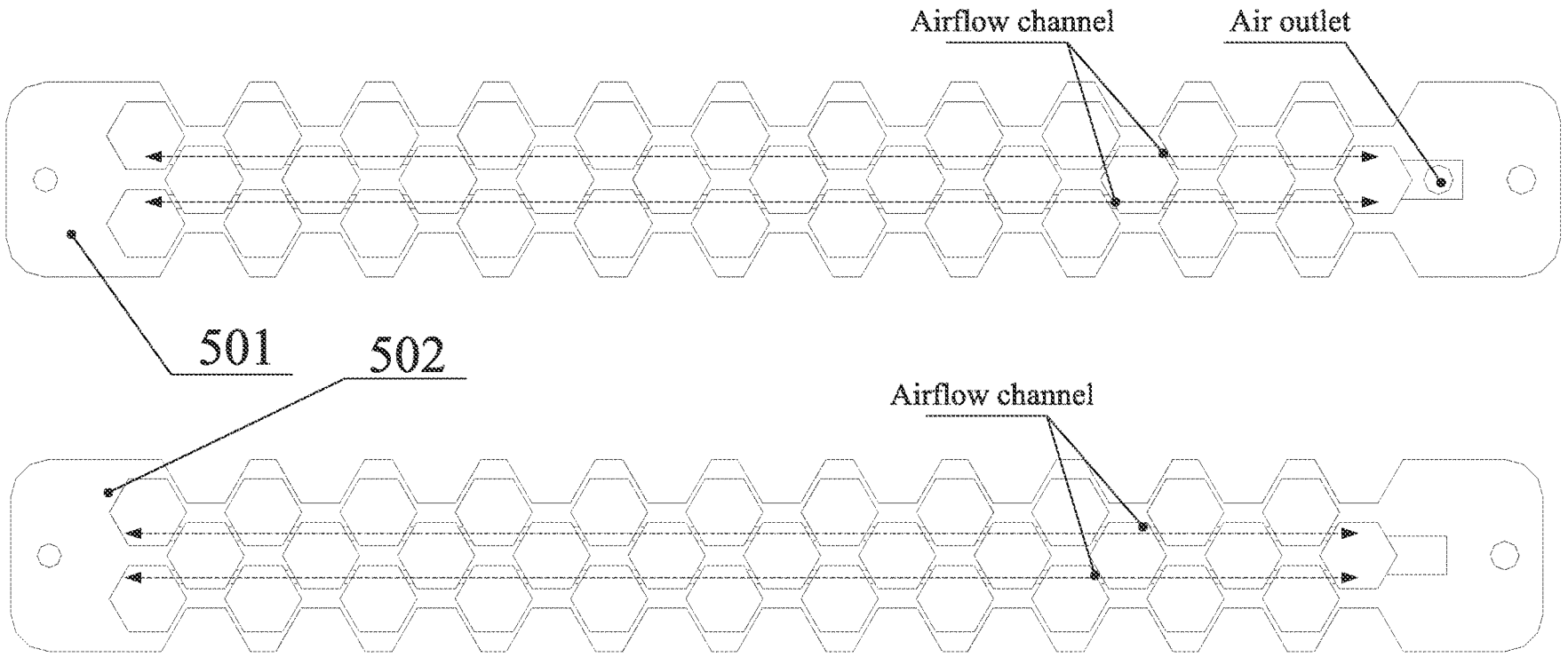
FIG. 6 is a structural drawing of upper and lower portions of a negative-pressure linear actuator driver in FIG. 4 or 5.

As shown in FIG. 6, the negative-pressure linear actuator driver 303 includes an upper half negative-pressure linear actuator 501 and a lower half negative-pressure linear actuator 502. The upper half negative-pressure linear actuator 501 has the exactly same structure as the lower half negative-pressure linear actuator 502, except for an air outlet for negative pressure input and positive pressure input that is connected to the outside, both of which are heat-sealed and welded together by a thermal bonding process to ensure the airtightness of a binding site. The air outlet of the upper half negative-pressure linear actuator 501 is used to connect the air tube to achieve the negative pressure input or output for the entire negative-pressure linear actuator driver. The upper half negative-pressure linear actuator 501 and the lower half negative-pressure linear actuator 502 are made of rubber materials, and can also be made of silicone materials.

Figure 7:
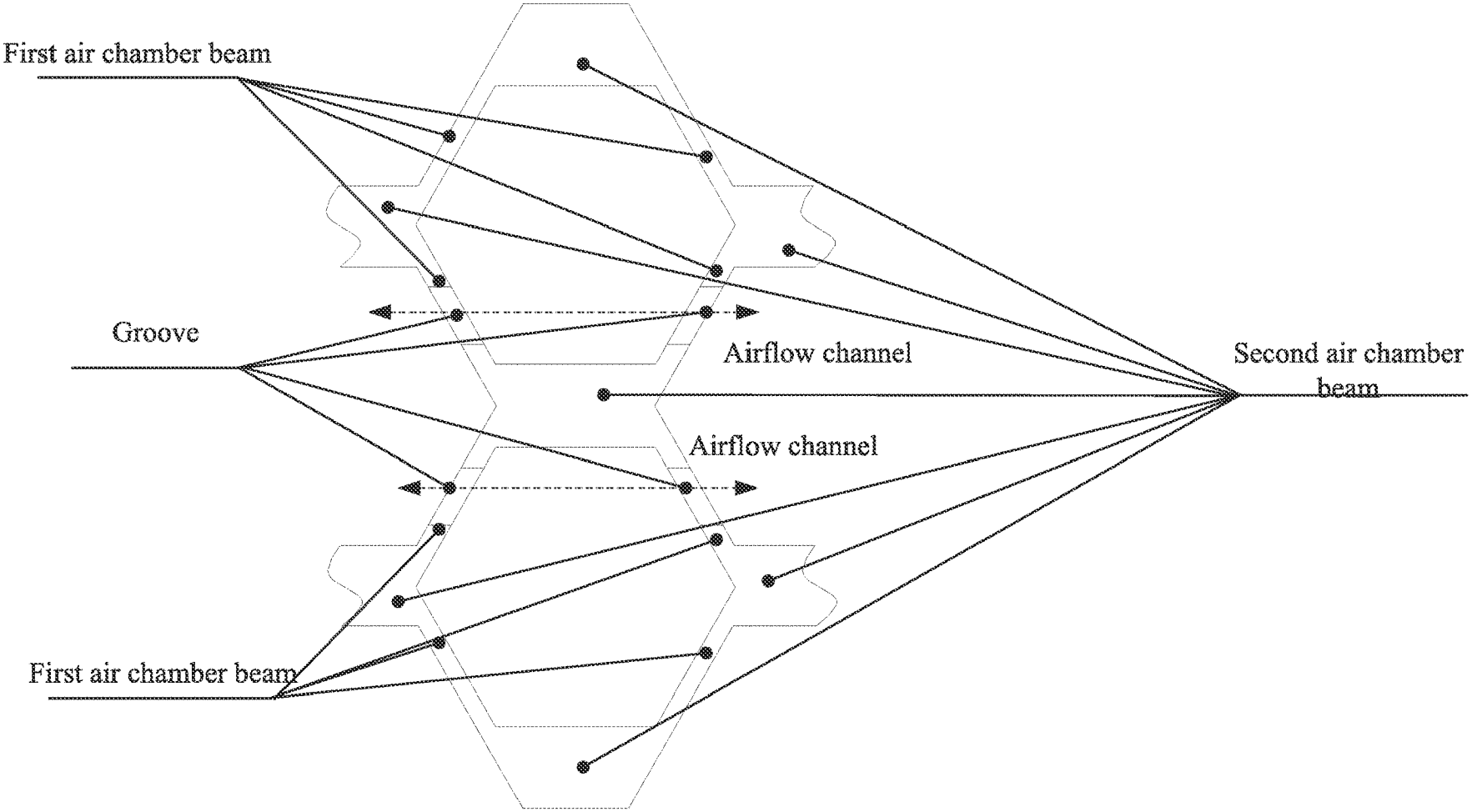
FIG. 7 is a structural schematic diagram of two adjacent units in a negative-pressure linear actuator driver of FIG. 6.
Figure 8:
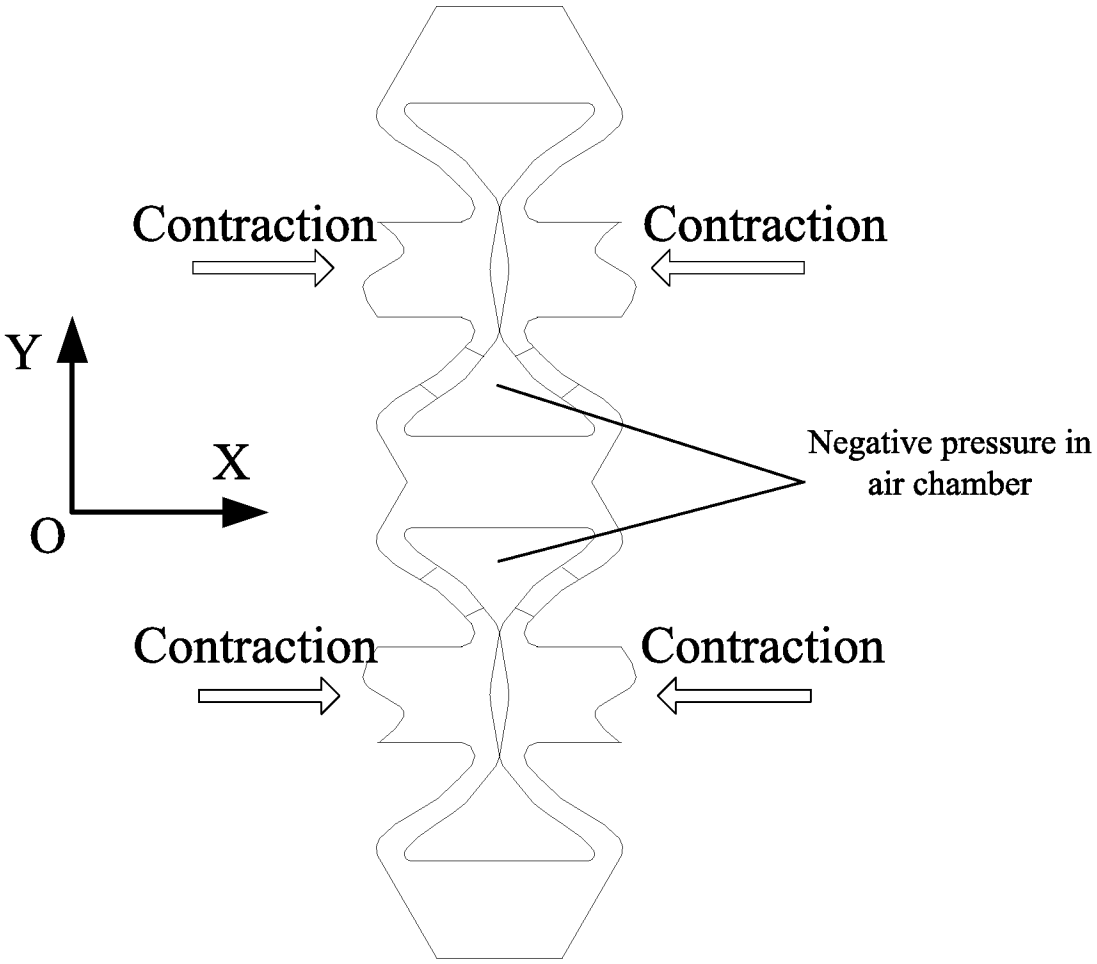
FIG. 8 is a mechanism diagram of two adjacent units in a negative-pressure linear actuator driver of FIG. 7 under the action of a negative pressure.

The upper half negative-pressure linear actuator 501 and the lower half negative-pressure linear actuator 502 are internally of a hexahedral structure. As shown in FIGS. 6 and 7, six air chamber beams of a single air chamber are different in thickness, wherein the thickness of the second air chamber beam is three times the first air chamber beam. Grooves are formed on four adjacent first air chamber beams of the upper and lower adjacent air chambers to form an airflow channel of the negative-pressure linear actuator driver 303, and no groove is formed on the other four nonadjacent first air chamber beams; and no groove is formed on the second air chamber beam to ensure airtightness. As shown in FIGS. 7 and 8, when the air chamber is under negative pressure, the first air chamber beam is deformed by the negative pressure force and contracts in an X axis direction to form a linear displacement; the second air chamber beam is not deformed under the action of the negative pressure and has no contraction displacement in a Y axis direction due to thick beam. Therefore, when the negative pressure acts, the negative-pressure linear actuator driver 303 can form a linear displacement from the natural state to the contraction state. When the external negative pressure action disappears, the first air chamber beam disappears due to the negative pressure force and extends in the opposite direction of the X axis, and gradually restores to the initial state of being not subjected to stress, and a horizontal displacement is formed in the process which is controllable; and the second air chamber beam is basically not deformed and has no contraction or extension displacement in a Y direction due to the thick beam. Therefore, during the disappearance of the external negative pressure action, the negative-pressure linear actuator driver 303 can form the linear displacement by restoring the contraction state to the natural state, and the process is controllable. In conclusion, the control of the linear displacement and the elastic force of the negative-pressure linear actuator driver 303 can be realized by controlling the input negative pressure and the input positive pressure.

In combination with FIGS. 1-8, during use, the exoskeleton controller 1 is worn at a waist of the user and is fastened with the soft belt 117. The left leg knee joint soft actuator 2 and the right leg knee joint soft actuator 3 are worn at corresponding positions on the knee joint of the user. During the walk of the human, the DSP embedded control system 108 estimates and predicts the human-machine cooperation state by performing real-time processing on parameters detected by a sensing system of the soft knee exoskeleton, such as change in a knee joint angle and an angular velocity, a human-machine acting force, a muscle force and a joint torque, controls an output flow of the miniature vacuum negative pressure pump 103 in real time and controls the vacuum solenoid valve A 106 and the vacuum solenoid valve B 107 to perform the air channel switching. The negative pressure input control is performed on the negative-pressure linear actuator driver 303 on the soft torque execution component A 202 and the soft torque execution component B 203 based on the human-machine cooperation state, namely, real-time and simultaneous control is performed on the angular velocity and the angular acceleration of an angle at which the left calf brace 302 rotates around the rotating shaft 304 with regard to the left thigh brace 301, or the angular velocity and the angular acceleration of an angle at which the right calf brace 402 rotates around the rotating shaft 304 with regard to the right thigh brace 401, thereby controlling the bending torque output of the soft torque execution component A 202 and the soft torque execution component B 203, and achieving real-time control in a process that the left leg knee joint soft actuator 2 provides the bending torque for the knee joint of the user.

Conversely, since the vacuum solenoid valve A 106 and the vacuum solenoid valve B 107 are three-way vacuum air valves, when the DSP embedded control system 108 controls the miniature vacuum negative pressure pump 103 to stop working and is closed by controlling the vacuum solenoid valve A 106 or the vacuum solenoid valve B 107, outside air can enter the negative-pressure linear actuator driver 303 through the vacuum solenoid valve A 106 via the air tube A 209 and the air tube B 210; or enter the negative-pressure linear actuator driver 303 through the vacuum solenoid valve B 107 via the air tube 211 and the air tube 212. In this process, the DSP embedded control system 108 can realize the real-time control to a length change and an elastic restoring force of the negative-pressure linear actuator driver 303 from a contraction process to an extension process by controlling a closing process of the vacuum solenoid valve A 106 or the vacuum solenoid valve B 107; and in this process, the elastic restoring forces of the latex rubber band 310 on the end faces of the left thigh brace 301 and the left calf brace 302 and the latex rubber band 310 on the end faces of the right thigh brace 301 and the right calf brace 302 act on the left thigh brace 301 and the left calf brace 302 as well as the right thigh brace 301 and the right calf brace 302 together with the negative-pressure linear actuator driver 303, to form an extended torque of the left leg knee joint soft actuator 2. The DSP embedded control system 108 achieves the real-time control in the process that the left leg knee joint soft actuator 2 and the right leg knee joint soft actuator 3 provide the extension torque for the knee joint of the user by controlling the closing process of the miniature vacuum negative pressure pump 103 and the vacuum solenoid valve A 106 or the vacuum solenoid valve B 107.

The working principle of the soft knee exoskeleton in a gait cycle is described in conjunction with FIGS. 1-8.

When the right leg begins to lift gradually, the right leg knee joint is stepped gradually from stretching to bending. In this process, the right leg knee joint needs a bending torque. The DSP embedded control system 108 estimates and predicts the human-machine cooperation state by performing real-time processing on parameters detected by the sensing system of the soft knee exoskeleton, such as the change in the knee joint angle and the angular velocity, the human-machine acting force, the muscle force and the joint torque, and controls the start of the miniature vacuum negative pressure pump 103. The negative pressure force generated by the miniature vacuum negative pressure pump 103 is transmitted to the vacuum solenoid valve A 106 and the vacuum solenoid valve B 107 through the T-type three-way adapter 105. The DSP embedded control system 108 controls the vacuum solenoid valve A 106 to open and the vacuum solenoid valve B 107 to close, and the negative pressure force acts on the negative-pressure linear actuator driver 303 on the soft torque execution component A 202 and the soft torque execution component B 203 of the right leg knee joint soft actuator 3 successively through the vacuum solenoid valve A 106, the right air tube R 110, the Y-type three-way adapter A 207, the air tube A 209 and the air tube B 210. The negative-pressure linear actuator driver 303 is subjected to the negative pressure force to generate a linear displacement and an elastic force with shortened contraction, while driving the left calf brace 302 to rotate around the rotating shaft 304 with respect to the left thigh brace 301, and driving the right calf brace 402 to rotate around the rotating shaft 304 with respect to the right thigh brace 401, thereby providing a bending driving force for the soft torque execution component A 202 and the soft torque execution component B 203. The DSP embedded control system 108 realizes the real-time control on the soft knee joint actuator 2 worn on the right leg by real-time control of the length change of the negative-pressure linear actuator driver 303 according to the estimation and prediction of the human-machine cooperation state, thereby enabling the right leg knee joint soft actuator 3 to assist the right leg knee joint in bending in real time according to the change of the right leg knee joint angle.

Then, the right leg transits from a vacant period to a support period, a right foot gradually touches the ground, and the right leg knee joint is gradually extended by the bending. In this process, the right leg knee joint needs the extended torque. The DSP embedded control system 108 controls the miniature vacuum negative pressure pump 103 to stop working by the estimation and prediction of the human-machine cooperation state. The DSP embedded control system 108 controls the vacuum solenoid valve A 106 to close, and the outside air (an atmospheric pressure) can enter the negative-pressure linear actuator driver 303 (namely, the positive pressure input) through the vacuum solenoid valve A 106 via the air tube 209 and the air tube 210, and the elastic force of the negative-pressure linear actuator driver 303 acts together with the elastic restoring force of the latex rubber band 310 to drive the left calf brace 302 of the right leg to rotate around the rotating shaft 304 with respect to the left thigh brace 301 of the right leg and drive the right calf brace 402 of the right leg to rotate around the rotating shaft 304 with respect to the right thigh brace 301 of the right leg, thereby providing the extended driving force for the soft torque execution component A 202 and the soft torque execution component B 203. The DSP embedded control system 108 realizes the real-time control for the execution process of the right leg knee soft joint actuator 3 by performing the real-time control on the linear displacement of the negative-pressure linear actuator driver 303, restoration from the contraction state to the natural state and the elastic restoring force of the latex rubber band 310 according to the estimation and prediction of the human-machine cooperation state, thereby enabling the right leg knee joint soft actuator 3 to assist the right leg knee joint in extending in real time according to the change of the right leg knee joint angle.

Then, a left foot is gradually lifted, the left leg transits from the support period to the vacant period, and the left leg knee joint is stepped gradually from extending to bending. In this process, the left leg knee joint needs a bending torque. The DSP embedded control system 108 controls the start of the miniature vacuum negative pressure pump 103 by the estimation and prediction of the human-machine cooperation state. The negative pressure force generated by the miniature vacuum negative pressure pump 103 is transmitted to the vacuum solenoid valve A 106 and the vacuum solenoid valve B 107 through the T-type three-way adapter 105. The DSP embedded control system 108 controls the vacuum solenoid valve B 107 to open and the vacuum solenoid valve A 106 to close, and the negative pressure force acts on the negative-pressure linear actuator driver 303 on the soft torque execution component A 202 and the soft torque execution component B 203 of the left leg knee joint soft actuator 2 successively through the vacuum solenoid valve B 107, the right air tube R 111, the Y-type three-way adapter A 208, the air tube 211 and the air tube 212. The negative-pressure linear actuator driver 303 is subjected to the negative pressure force to generate a linear displacement and an elastic force with shortened contraction, while driving the left calf brace 302 to rotate around the rotating shaft 304 with respect to the left thigh brace 301, and driving the right calf brace 402 to rotate around the rotating shaft 304 with respect to the right thigh brace 401, thereby providing a bending driving force for the soft torque execution component A 202 and the soft torque execution component B 203. The DSP embedded control system 108 realizes the real-time control on the left leg knee joint soft actuator 2 by performing real-time control on the length change of the negative-pressure linear actuator driver 303 according to the estimation and prediction of the human-machine cooperation state, thereby enabling the left leg knee joint soft actuator 2 to assist the left leg knee joint in bending in real time according to the change of the left leg knee joint angle.

Finally, the left leg transits from the vacant period to the support period, the left foot gradually touches the ground, and the left leg knee joint is gradually extended by the bending. In this process, the left leg knee joint needs the extended torque. The DSP embedded control system 108 controls the miniature vacuum negative pressure pump 103 to stop working by the estimation and prediction of the human-machine cooperation state. The DSP embedded control system 108 controls the vacuum solenoid valve B 107 to close, and the outside air (an atmospheric pressure) can enter the negative-pressure linear actuator driver 303 (namely, the positive pressure input) through the vacuum solenoid valve B 107 via the air tube 211 and the air tube 212, and the elastic force of the negative-pressure linear actuator driver 303 acts together with the elastic restoring force of the latex rubber band 310 to drive the left calf brace 302 of the left leg to rotate around the rotating shaft 304 with respect to the left thigh brace 301 of the left leg and drive the right calf brace 402 of the left leg to rotate around the rotating shaft 304 with respect to the right thigh brace 301 of the left leg, thereby providing the extended driving force for the soft torque execution component A 202 and the soft torque execution component B 203. The DSP embedded control system 108 realizes the real-time control on the left leg knee joint soft actuator 2 by performing the real-time control on the linear displacement of the negative-pressure linear actuator driver 303, restoration from the contraction state to the natural state and the elastic restoring force of the latex rubber band 310 according to the estimation and prediction of the human-machine cooperation state, thereby enabling the left leg knee joint soft actuator 2 to assist the left leg knee joint in extending in real time according to the change of the left leg knee joint angle.

The above describes a walking-assisting function of the soft knee exoskeleton driven by the negative-pressure linear actuator to realize a gait cycle. In this repeated cycle, the soft knee exoskeleton can acquire parameters such as the muscle force, the knee joint angle and the human-machine interaction force by the sensing system of the soft knee exoskeleton formed by the inertial measurement unit component, the force sensor and the surface myoelectric sensor in the walking process of the human. The DSP embedded control system performs the real-time processing on the data detected by the sensing system, estimates the human-machine cooperation state, and performs real-time control on the switching of the negative pressure flow and the air channel of the miniature vacuum negative pressure pump. The pressure control is performed on the corresponding negative-pressure linear actuator drivers on the left leg knee joint soft actuator and the right leg knee joint soft actuator based on the human-machine cooperation state. In the walking process, the torque which is consistent with the gait and assists the knee joint in bending and extending is provided for the left and right legs, thereby achieving the purpose of providing soft walking assistance for the elderly people with knee joint motion injuries and weak walking ability.

The soft knee exoskeleton of the human-machine cooperation in the present invention adopts the negative-pressure linear actuator as the soft driving element, and thus has the characteristics of high power-to-density ratio and power-to-volume ratio and linear deformation, and is easy to realize linear control. Secondly, the present invention uses an inertial measurement unit component, the force sensor and the surface myoelectric sensor to form the sensing system of the soft knee exoskeleton. The sEMG contains a variety of muscular activity information, which can directly reflect the functional state and motion information of the muscle. By establishing a muscle-skeletal model driven by the surface myoelectric sensor (forward dynamics) and combining the inertial information of the inertial measurement unit component, the parameter identification is performed; the muscle force and the knee joint angle are estimated and predicted; and the human-machine cooperation state is estimated to improve the coordination and safety of the soft exoskeleton. Furthermore, the wearable soft actuator in the present invention adopts a pneumatic driving mode, which overcomes the disadvantages of large inertia, easy mechanical inertia damage of the knee joint, poor safety and poor comfort of general leg power assisting equipment or an exoskeleton robot and other rigid mechanisms, thereby significantly improving the safety and comfort of the equipment.

The above-mentioned embodiment is only one of preferred specific embodiments of the present invention, and the general changes and substitutions made by those skilled in the art within the scope of the technical solution of the present invention shall be included in the protection scope of the present invention.

We claim:

1. A soft knee exoskeleton driven by a negative-pressure linear actuator, comprising:

an exoskeleton controller;

a left leg knee joint soft actuator worn on a left leg knee joint and capable of assisting knee joint motion of a left leg;

a right leg knee joint soft actuator worn on a right leg knee joint and capable of assisting knee joint motion of a right leg, wherein the left leg knee joint soft actuator and the right leg knee joint soft actuator comprise a pneumatic driving mechanism and a sensing system;

the pneumatic driving mechanism can accept a power outputted by the exoskeleton controller to provide a torque for the knee joints; the sensing system can detect human-machine interaction state data; and the control part can process the data detected by the sensing system and control the power output of the left leg knee joint soft actuator and the right leg knee joint soft actuator;

the exoskeleton controller comprises: a controller body, an end cover, a miniature vacuum negative pressure pump, a mounting plate, a T-type three-way adapter, a vacuum solenoid valve A, a vacuum solenoid valve B, a driver, a DSP embedded control system, a lithium battery pack, a wireless receiving and transmitting module, a switch, a right air tube R, a left air tube L, a heat sink block A, a heat sink block B and a soft belt;

each of the left leg knee joint soft actuator and the right leg knee joint soft actuator comprises a knee joint elastic sheath, a soft torque execution component A, a soft torque execution component B, a Y-type three-way adapter, an air tube component, an inertial measurement unit (IMU) component, a force sensor, a surface myoelectric sensor (sEMG) and elastic cloth.

2. The soft knee exoskeleton according to claim 1, wherein the soft torque execution component A comprises a left thigh brace, a left calf brace, a negative-pressure linear actuator driver, a rotating shaft, a connector, a screw, a fastener, a pressing piece component, a latex rubber hand and an air tube connecting end; a triangular structural form with fixed lengths on both sides and a variable length on the third side is formed by the left thigh brace, the left calf brace and the negative-pressure linear actuator driver; the relative rotation of the other two fixed sides is achieved by the change in the length of the third side; and the soft torque execution component A is stitched to a position corresponding to a left knee joint of a knee joint elastic sheath by the elastic cloth.

3. The soft knee exoskeleton according to claim 1, wherein the soft torque execution component B comprises a right thigh brace, a right calf brace, a negative-pressure linear actuator driver, a rotating shaft, a connector, a screw, a fastener, a pressing piece component, a latex rubber band and an air tube connecting end; a triangular structural form with fixed lengths on both sides and a variable length on the third side is formed by the right thigh brace, the right calf brace and the negative-pressure linear actuator driver; the relative rotation of the other two fixed sides is achieved by the change in the length of the third side; and the soft torque execution component B is stitched to a position corresponding to a right knee joint of a knee joint elastic sheath by the elastic cloth.

4. The soft knee exoskeleton according to claim 2, wherein the left leg knee joint soft actuator and the right leg knee joint soft actuator provide the auxiliary torque for the knee joints through the simultaneous action of the soft torque execution component A and the soft torque execution component B.

5. The soft knee exoskeleton according to claim 2, wherein when the negative-pressure linear actuator driver has a negative-pressure input, the driver has shorter linear displacement, a tensile force, and basically unchanged size in the direction perpendicular to the linear displacement;

on the contrary, when the negative pressure of the negative-pressure linear actuator driver gradually disappears, the driver has an elastic acting force in a process of restoring from a contraction state to a natural state.

6. The soft knee exoskeleton according to claim 5, wherein during the process that the negative pressure action of the negative-pressure linear actuator driver gradually disappears, the latex rubber band on the end faces of the braces on both sides of the thigh and the braces on both sides of the calf is no longer subjected to an external force, and thus, jointly acts with the negative-pressure elastomer to drive the relative rotation of the braces on both sides of the thigh and the braces on both sides of the calf and an extended torque is generated, thereby realizing the function of the soft torque execution component A and the soft torque execution component B to provide an auxiliary extension torque for the knee joints.

7. The soft knee exoskeleton according to claim 2, wherein the negative-pressure linear actuator driver comprises an upper half part and a lower half part which are basically symmetrical; the upper half part has a vent hole with the outside used to connect the air tubes to realize the negative pressure input or positive pressure input to the entire negative-pressure linear actuator driver; the upper half part and the lower half part of the negative-pressure linear actuator driver respectively comprise an air chamber of a hexagonal prism structure; air holes are formed on each air chamber to form an airflow channel of the negative-pressure linear actuator driver; six air chamber beams of the side surface of a single air chamber are different in thickness; the thickness of the second air chamber beam is three times the first air chamber beam; when the air chamber is under negative pressure, the first air chamber beam is deformed by the negative pressure force and contracts in an X axis direction to form a linear displacement; the second air chamber beam is not deformed and has no contraction displacement in a Y axis direction; therefore, when the negative pressure acts, the negative-pressure linear actuator driver can form a horizontal linear displacement; when the external negative pressure action disappears, the first air chamber beam disappears due to the negative pressure force and extends in the opposite direction of the X axis, and gradually restores to the initial state of being not subjected to stress, and a horizontal displacement is formed in the process which is controllable; and the second air chamber beam is not deformed and has no contraction or extension displacement in a Y direction.

8. The soft knee exoskeleton according to claim 1, wherein the inertial measurement unit (IMU) component is a sensor that detects the change of a knee joint angle and/or angular velocity;

the surface myoelectric sensor (sEMG) is a sensor that detects a muscle force and a joint torque;

the force sensor is a sensor that acquires a human-machine interaction force between the soft knee exoskeleton and a human leg;

the sensing system of the soft knee exoskeleton is formed by the inertial measurement unit (IMU) component, the surface myoelectric sensor (sEMG) and the force sensor;

the wireless receiving and transmitting module is a communication module between the DSP embedded control system and the sensing system;

the DSP embedded control system performs real-time processing on the parameters of the knee joint angle and/or angular velocity of the left and right legs acquired by the inertial measurement unit module, estimates and predicts a muscle force, a joint torque and a human-machine interaction force detected by the force sensor and the surface myoelectric sensor (sEMG), performs real-time control on the output flow of the miniature vacuum negative pressure pump and switches an air channel of a vacuum solenoid valve A and a vacuum solenoid valve B;

the real-time negative pressure input and positive pressure input control is performed on the negative-pressure linear actuator drivers in a soft torque execution component A and a soft torque execution component B on the left leg knee joint soft actuator and the right leg knee joint soft actuator based on a human-machine cooperation state, thereby controlling the torque output of the left leg knee joint soft actuator and the right leg knee joint soft actuator in real time.

* * * * *